US005403444A

United States Patent [19]

Goettmann et al.

[11] Patent Number: 5,403,444

[45] Date of Patent: Apr. 4, 1995

[54] PRINTABLE, HIGH-STRENGTH, TEAR-RESISTANT NONWOVEN MATERIAL AND RELATED METHOD OF MANUFACTURE

[75] Inventors: James A. Goettmann, North East; John R. Boylan, Newtown, both of Pa.

[73] Assignee: International Paper Company, Purchase, N.Y.

[21] Appl. No.: 916,819

[22] Filed: Jul. 20, 1992

Related U.S. Application Data

[63] Continuation-in-part of Ser. No. 489,427, Mar. 5, 1990, Pat. No. 5,133,835.

[51] Int. Cl.[6] ..... D21H 13/10

[52] U.S. Cl. ..... 162/146; 162/157.3; 162/206; 162/207

[58] Field of Search ..... 162/146, 157.3, 206, 162/207, 168.1, 169, 183

[56] References Cited

U.S. PATENT DOCUMENTS

| | | | |
|---|---|---|---|
| 3,097,991 | 7/1963 | Miller et al. | 162/157 |
| 3,158,532 | 11/1964 | Pall et al. | 162/146 |
| 3,282,038 | 11/1966 | Howell | 162/146 |
| 3,489,643 | 1/1970 | Hoffman | 162/146 |
| 3,515,634 | 6/1970 | Sommer et al. | 162/146 |
| 3,674,621 | 7/1972 | Miyamoto et al. | 162/146 |
| 4,162,180 | 7/1979 | Burton et al. | 156/220 |
| 4,210,487 | 7/1980 | Driscoll | 162/146 |
| 4,460,647 | 7/1984 | Keith | 428/369 |
| 4,496,583 | 1/1985 | Yamamoto et al. | 162/157.3 |
| 4,615,689 | 10/1986 | Murray et al. | 493/51 |
| 4,894,280 | 1/1990 | Guthrie et al. | 428/224 |
| 4,973,382 | 11/1990 | Kinn et al. | 162/146 |
| 5,009,747 | 4/1991 | Viazmensky et al. | 162/146 |

FOREIGN PATENT DOCUMENTS

| | | |
|---|---|---|
| 787649 | 6/1968 | Canada . |
| 63-159599 | 12/1986 | Japan . |
| 708622 | 7/1951 | United Kingdom . |

OTHER PUBLICATIONS

"Synthetic Fiber Papers proved in Pilot Mill Runs", Paper Trade Journal, Mar. 5, 1966, pp. 38,40.

Publication "Research Disclosure 102", Oct. 1972, pp. 24–25.

*Primary Examiner*—Peter Chin

*Attorney, Agent, or Firm*—Ostrager, Chong & Flaherty

[57] ABSTRACT

A nonwoven composite web consists of 15 to 50 wt. % of first polyester fibers having a length of 5 mm to ¾ inch and a denier of 0.3 to 3, 5 to 50 wt. % of second polyester fibers having a length of 5 mm to 1-½ inches and a denier of 3 to 15, and 10 to 40 wt. % of binder fibers comprising thermoplastic binder material having a melting temperature which is less than the first and second melting temperatures respectively. The first and second polyester fibers are bonded to each other at least in part by solidification of the thermoplastic binder material after subjecting the web to temperatures in excess of the melting temperature of the binder material but not in excess of the melting temperature of either the first or second polyester fibers. In particular, the web is thermally bonded by calendaring at a temperature of in the range of 360° to 410° F. and at a pressure in the range of 40 to 70 psi. Preferably the binder fibers comprise bicomponent fibers having a co-polyester sheath and a polyester core.

17 Claims, 9 Drawing Sheets

PRINTABLE, HIGH-STRENGTH, TEAR-RESISTANT NONWOVEN MATERIAL AND RELATED METHOD OF MANUFACTURE

RELATED APPLICATION

This is a continuation-in-part of application Ser. No. 07/489,427, filed on Mar. 5, 1990, now U.S. Pat. No. 5,133,835.

FIELD OF THE INVENTION

This invention generally relates to high-tensile-strength synthetic nonwoven materials fabricated by wet-laid processes. In particular, the invention relates to a paper-like web made with polyester fibers which provides a high-strength printable protective wrap material.

BACKGROUND OF THE INVENTION

High-tensile-strength paper-like webs made of synthetic nonwoven composites have diverse application as insulating housewrap, bookbinding and protective wrap materials. For such applications it is advantageous to provide a paper-like material which is printable and characterized by high tear resistance.

A known material suitable for use as a housewrap and other high-strength applications is marketed under the brand designation TYVEK by E. I. Du Pont de Nemours and Company, Wilmington, Del. TYVEK is 100% spunbond polyethylene fiber bonded by heat and pressure. TYVEK style 1042B, which is marketed as a housewrap material, has the following properties: basis weight —26 lb/3000 $ft^2$; thickness—4.9 mils; tensile MD—20 lb/inch; tensile CD—22 lb/inch; tear MD—0.7 lb; tear CD—0.7 lb; opacity—75%; internal bond—0.35 lb/inch.

U.S. Pat. No. 4,162,180 to Burton et al. discloses a flexible wall covering material comprised of pulp and two thermoplastic polymeric fibers having different plasticity temperatures. The polymeric fibers are selected from the group consisting of polyolefins, polyamides, polyesters, polyurethanes, polycarbonates, vinyl and acrylic resins. In wall covering applications, the sheet material is heated to a temperature intermediate the plasticity temperatures of the two thermoplastic materials, so that the fibers of one of the thermoplastic materials are rendered plastic and fuse together to form a three-dimensional network in the sheet while the other thermoplastic material retains its fibrous structure.

Canadian Patent No. 787,649 discloses nonwoven materials made of a mixture of three-dimensionally oriented fibers of different lengths. In accordance with the disclosure of this prior art, synthetic fibers, natural fibers and fibers made of inorganic materials can be used either alone or in a mixture with each other. The synthetic fibers may include polyamides, polyesters, polyacrylonitrile, polyvinyl chloride, polyvinylidene chloride, polyolefins and polyurethanes used alone or in mixture with each other. The Canadian patent discloses that the synthetic fibers can be of different lengths. In particular, in Examples 1 and 7 a nonwoven material is described which includes polyethylene terephthalate fibers of four different staple lengths. Example 4 is directed to a nonwoven material which includes polyethylene terephthalate fibers of six different staple lengths.

SUMMARY OF THE INVENTION

It is a broad object of the present invention to provide a paper-like web made of synthetic nonwoven composite material which has improved printability, strength and tear resistance and related method of its manufacture.

It is another object of the invention to provide a paper-like web made of synthetic nonwoven composite material suitable for housewrap and other protective covering applications.

Another object of the invention to provide an economical and efficient method for producing a paper-like web made of synthetic nonwoven composite material having improved printability, strength and tear resistance.

A further object of the invention is to provide a housewrap material in the form of a nonwoven web having improved strength due to the elimination of wood pulp from the fiber composition.

In the present invention, these purposes, as well as others which will be apparent from the detailed description below, are achieved generally by providing a composite material comprising first and second polyester fibers of different length and denier and a binder fiber for bonding the first and second polyester fibers in a nonwoven mat. The binder fiber contains thermoplastic material having a melting temperature different than that of the first and second polyester fibers. The thermoplastic material of the binder fiber can be a polymer different than polyester, e.g., co-polyester, or a polyester having a molecular weight which is different than the molecular weight of the first and second polyester fibers. Alternatively and preferably, the binder fiber comprises bicomponent fibers having a polyester core and a sheath made of a polymer different than polyester, e.g., co-polyester. The polyethylene has a melting point lower than the melting point of the polyester.

The component fibers are combined with water into a homogeneous mixture and formed into a mat employing a wet-lay process. A high strength paper-like material is formed by thermally bonding the mat under controlled temperature and pressure conditions.

Strength and porous characteristics are imparted to the composite by the combination of polyester fibers employed in the invention. In particular, the strength of the composite can be improved by varying the polyester fiber content in accordance with the following functional relations: (a) as the polyester denier increases at constant length and amount, the porosity, bulk and stiffness of the composite increase and the amount of fiber entanglement decreases; (b) as the polyester length increases at constant denier and amount, the tensile and tear strengths in the MD and CD directions and the Mullen burst strength increase and the stiffness decreases; and (c) as the quantity of polyester increases at constant denier and length, the tensile strength improves, Mullen burst and tear strengths, and porosity increase.

Other objects, features and advantages of the present invention will be apparent when the detailed description of the preferred embodiments of the invention is considered in conjunction with the drawings.

DETAILED DESCRIPTION OF THE PREFERRED EMBODIMENTS

Figure 1:
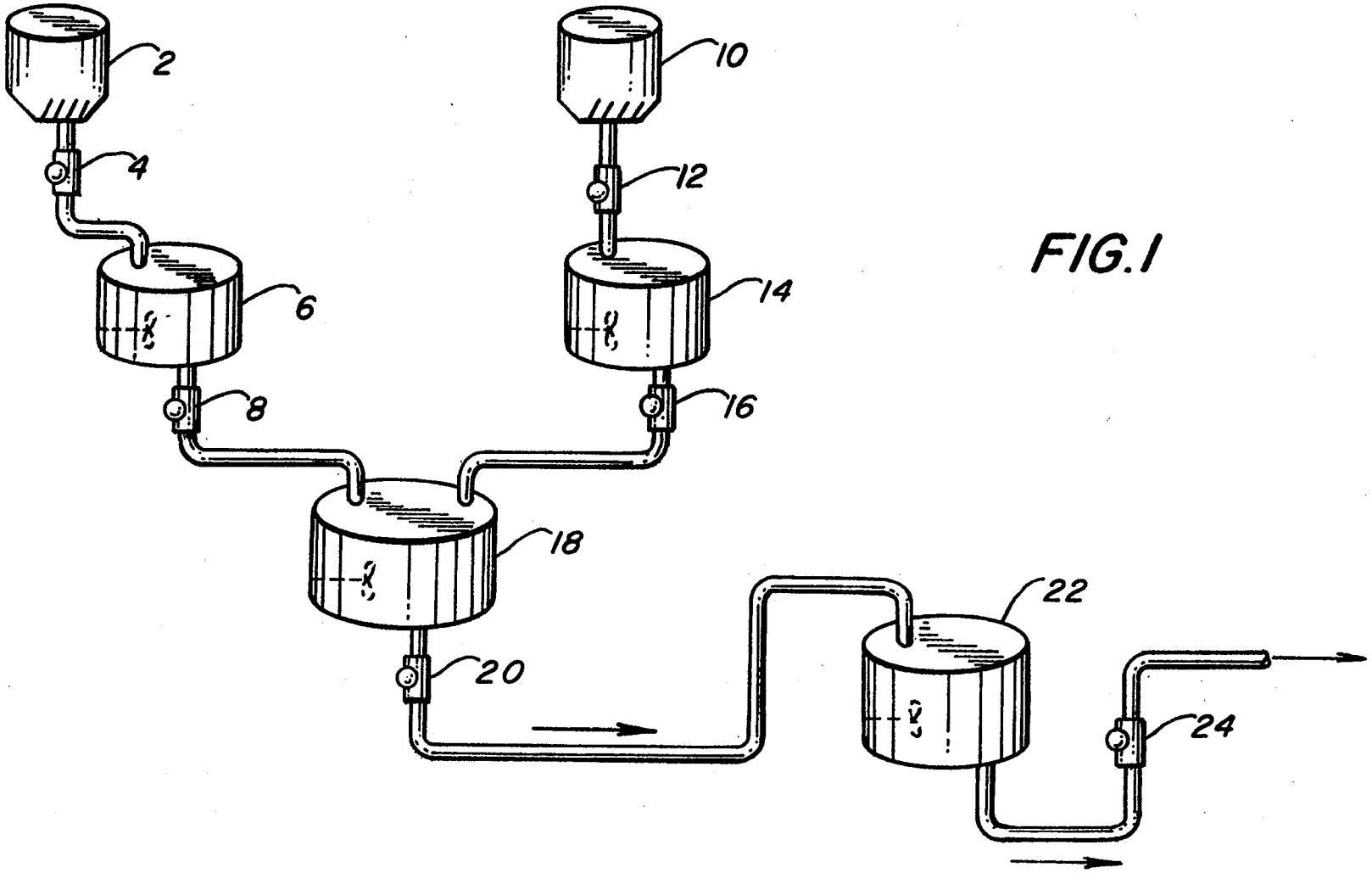
FIG. 1 is a diagrammatic view of an apparatus for preparation of stock or furnish for manufacture of the composite material of the invention.

In accordance with the invention, printable, high-strength, tear-resistant synthetic nonwoven composites are provided. The composite material comprises first and second polyester fibers of different length and denier and a binder fiber for bonding the first and second polyester fibers in a nonwoven mat. The binder fiber contains thermoplastic material having a melting temperature different than that of the first and second polyester fibers. A high strength paper-like material is formed by thermally bonding the nonwoven mat under controlled temperature and pressure conditions.

The first polyester fiber has a length which may vary from 5 mm to ¾ inch, preferably from ½ to ¾ inch, and a denier which may vary from 0.3 to 3. The second polyester fiber preferably has a length which may vary from 5 mm to 1-½ inch, preferably from ¾ to 1-½ inches, and a denier which may vary from 3 to 15. In a preferred embodiment, the first polyester fiber is ½-inch × 1.5-denier Type 101 polyester fiber and the second polyester fiber is 1-inch × 6.0-denier Type 101 polyester fiber, both supplied by Hoechst Celanese Corporation, Wilmington, Del. The first and second polyester fibers each constitute between 15 and 50 wt. % of the composite material.

The binder fiber is preferably a bicomponent fiber having a low-melting-point co-polyester sheath and a polyester core, e.g., 5-mm × 2.0-denier bicomponent binder fiber Type N-720 supplied by Kuraray Co., Ltd., Osaka, Japan. Alternatively, the binder fiber may comprise ½-inch × 3.0-denier polyester binder fiber, such as Type 259 supplied by Hoechst Celanese Corporation, Wilmington, Del. Other binder fibers can be used. The binder fiber content may vary between 10 and 40 wt. % of the composite material.

Table I sets forth the fiber specifications for a composite material in accordance with the preferred embodiment.

TABLE I

Material Specifications of Composite Material

| Component | Brand | Length/Denier | Weight (%) |
|---|---|---|---|
| Polyester fiber | Type 101 | ½" × 1.5 | 40.0 |
| Bicomponent binder fiber | N-720 | 5 mm × 2.0 | 20.0 |
| Polyester fiber | Type 101 | 1" × 6.0 | 40.0 |

In accordance with the method of the invention, a wet-laid mat of the composite material is dried at temperatures in the range of 200°–285° F. and then thermally calendared with rolls heated to temperatures of 380°–395° F. and nip pressures of 50 psi or greater. The preferred weight per unit area of the composite following thermal calendaring is 55 pounds per 3000 $ft^2$.

Optionally, the composite material may include polypropylene pulp. The polypropylene fiber content may vary between 0 and 20 wt. % of the composite material. The polypropylene fiber can be used to impart structural bonds to the composite during drying in the wet-lay process prior to thermal calendaring. Preferably the polypropylene fiber used is Pulpex P.A.D. having fibers of length 0.8 to 1.5 mm and diameter 20 to 40 microns. Pulpex P.A.D. is supplied by Hercules Inc., Wilmington, Del.

FIG. 1 illustrates an apparatus for preparation of stock or furnish for manufacture of the composite in accordance with a preferred embodiment containing polypropylene. A batch of polypropylene is prepared in a hydropulper 2 by filling the hydropulper with warm water, agitating the water, adding polypropylene fiber, and then agitating the mixture for approximately 20 minutes. The polypropylene slurry is then transported to a mixing chest 6 via a valve 4. In mixing chest 6 the polypropylene slurry is diluted to the desired consistency, that is, 1.0 to 2.5%.

At the same time a polyester fiber slurry is prepared in hydropulper 10 which contains water. In preparation of the slurry, the water is agitated, 0.5 lb. of a surfactant (Milease T supplied by ICI Americas, Inc., Wilmington, Del.) is added and the 1.5-denier polyester fibers and 2.0-denier bicomponent binder fibers are introduced into the slurry. Thereafter, the slurry is mixed for approximately 3 minutes to disperse the polyester and bicomponent fibers. As a web formation aid, an anionic polyacrylamide (2.0% solids based on fiber weight, Separan AP-273 supplied by Dow Chemical, Midland, Mich.) is added to the slurry followed by the 6.0-denier polyester fiber. The slurry is mixed for a sufficient time to disperse the polyester fiber in a uniform fashion. Visual inspection is used to determine when fibers are totally separated and well dispersed. The fiber slurry is then transported to mixing chest 14 via valve 12.

After the polypropylene slurry has been suitably mixed in mixing chest 6 and the polyester and bicomponent fibers have been suitably mixed in mixing chest 14, the slurries are respectively transported to blending chest 18 where the mixture is blended and diluted to the desired consistency, i.e., 0.01 to 0.1%. The slurry is transported to the machine chest 22 via a valve 20 and, thereafter to the web-forming machine via valve 24.

Figure 2:
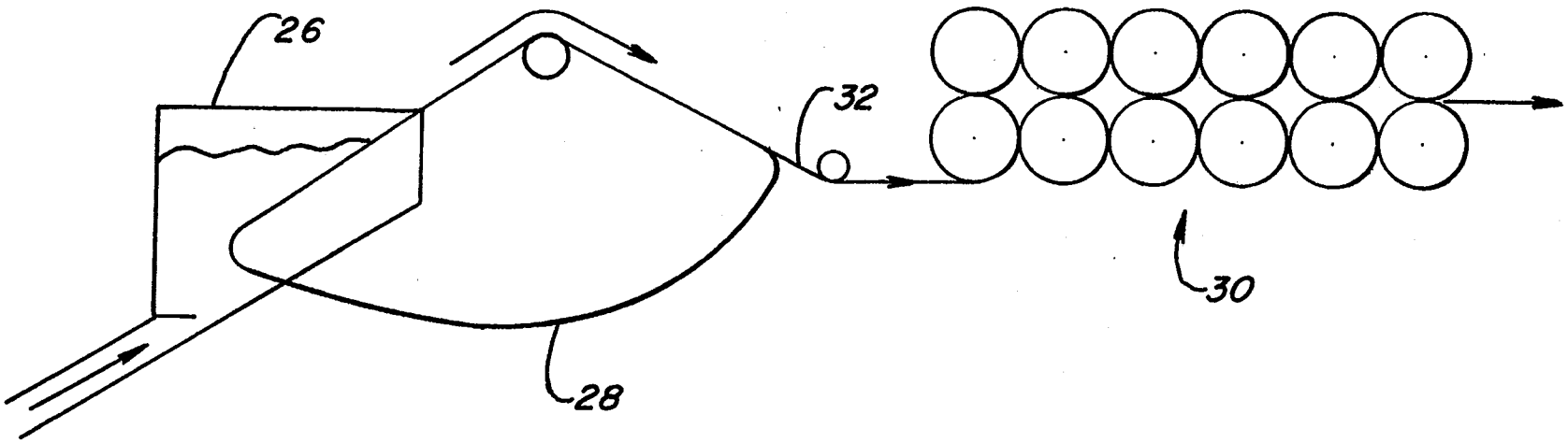
FIG. 2 is a diagrammatic view of an apparatus for formation and drying of a web employed in the manufacture of the composite material.

FIG. 2 is a diagrammatic view of an apparatus for formation and drying of a web employed in the manufacture of the composite in accordance with the invention. The homogeneous fiber slurry is received by headbox 26. A web 32 is formed by machine 28 using a wet-lay process in accordance with conventional papermaking techniques. Thereafter, the web 32 enters a stack of drying rollers 30, which remove water from the web. The dried web 32 is then wound up on a reel (not shown in FIG. 2) for further processing.

Figure 3:
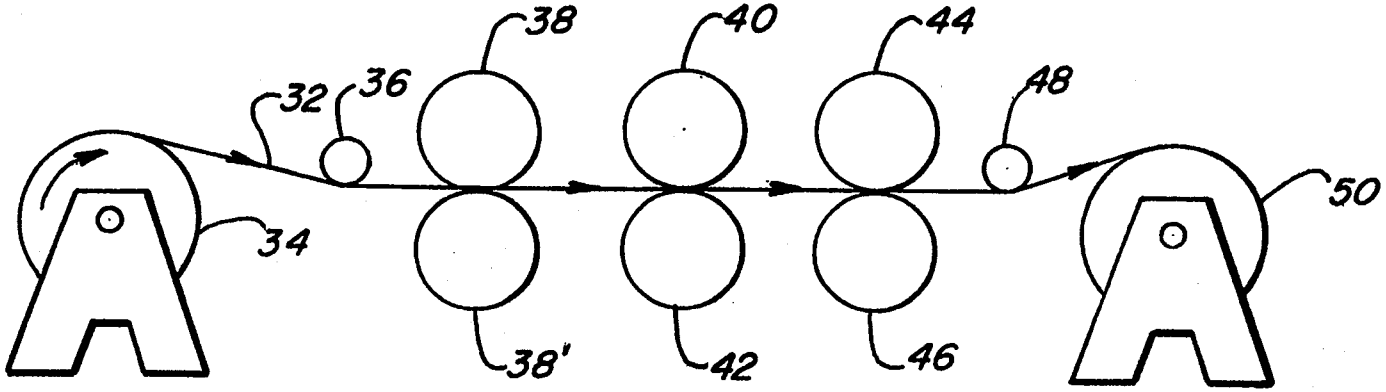
FIG. 3 is a diagrammatic view of an apparatus for thermally bonding the web to form the composite material of the invention.

A high-strength and densified composite material is provided by thermally bonding the dried web 32 in a calendar. See FIG. 3. On the process line, the web 32 is unwound from the reel 34, and fed by guide roll 36 to the nip between calendar rolls 38 and 38'. Calendar rolls 38 and 38' which are preferably fabricated of steel, are heated to a temperature and maintained at a compression pressure, respectively, in the range of 360°–410° F. and 40–70 psi. Preferred results are obtained at a temperature of approximately 385° F. and pressure of 50 psi.

Thereafter, the web in succession enters a second nip formed by a soft top roll 40 and a steel bottom roll 42 and a third nip formed by a steel top roll 44 and a soft bottom roll 46. The pressure at the second and third nips is 15 to 35 psi. After passing between rolls 44 and 46, the thermally bonded web contacts guide roll 49 and is then wound up on reel 50.

The same process can be used to make the preferred embodiment having no polypropylene, except that the steps relating to formation of a polypropylene slurry may be eliminated.

Table II sets forth physical properties of the preferred embodiment of the invention, i.e., the embodiment having no polypropylene, following thermal bonding.

TABLE II

| Physical Properties of Composite Material | | | |
|---|---|---|---|
| TAPPI* No. | Physical Property | Uncalendared | Calendared |
| 410 | Basis Weight (3000 ft$^2$) | 40.0 | 40.0 |
| | (oz./yd$^2$) | 2.0 | 2.0 |
| 411 | Caliper (mils) | 15.3 | 6.3 |
| 251 | Porosity-Permeability, Frazier Air (cfm) | 620 | 70 |
| 403 | Mullen Burst (psi) | 12 | 150 |
| 414 | Elmendorf Tear (gm) (MD/CD) | 350/Tears to length | 650/Will not tear |
| 511 | MIT Fold (MD/CD) | — | 2000+/2000+ |
| 494 | Instron Tensile (lb/in.) (MD/CD) | 2.2/1.4 | 34.4/26.6 |
| 494 | Elongation (%) (MD/CD) | 5.8/18.1 | 2.2/1.4 |
| 494 | TEA (ft-lb/ft$^2$) (MD/CD) | 1.8/3.0 | 8.2/3.9 |
| 452 | GE Brightness | 96.0 | 96.0 |
| 425 | Opacity (%) | 47.0 | 55.8 |

*Standards of the Technical Association of the Pulp and Paper Industry ("TAPPI"), Technology Park, Atlanta, Georgia.

Figure 4A:
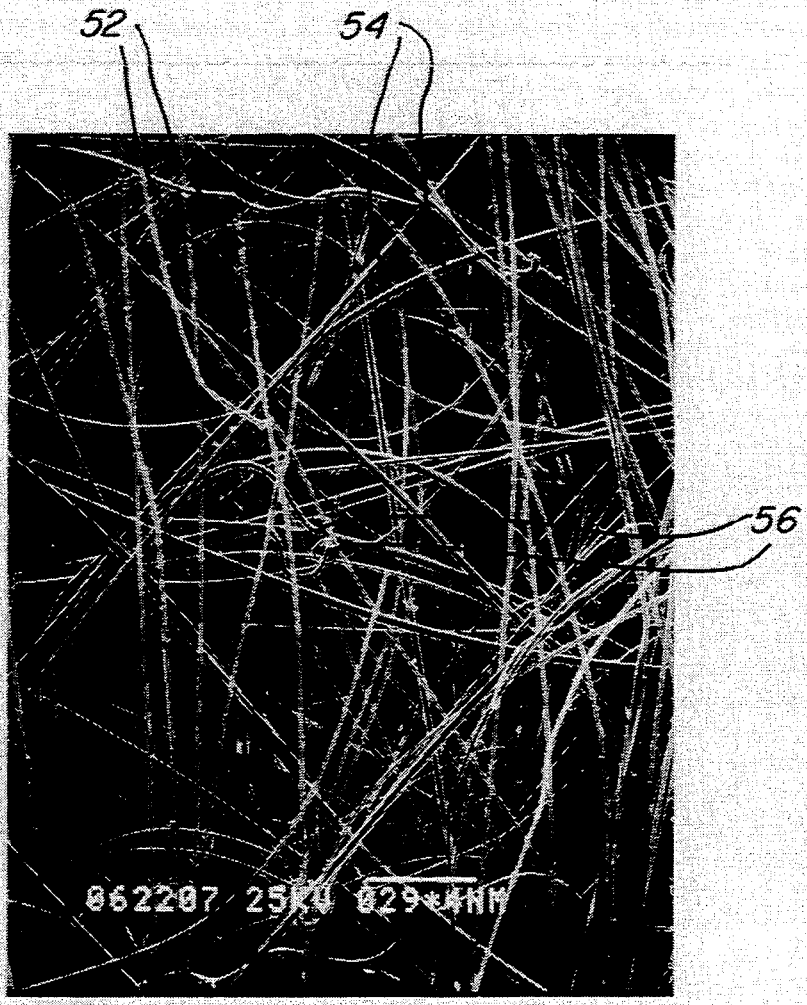
FIGS. 4A to 4C are photomicrographs, respectively at 50X, 100X and 200X magnification, showing the microstructure of an uncalendared web material in accordance with the preferred embodiment of the invention.
Figure 4B:
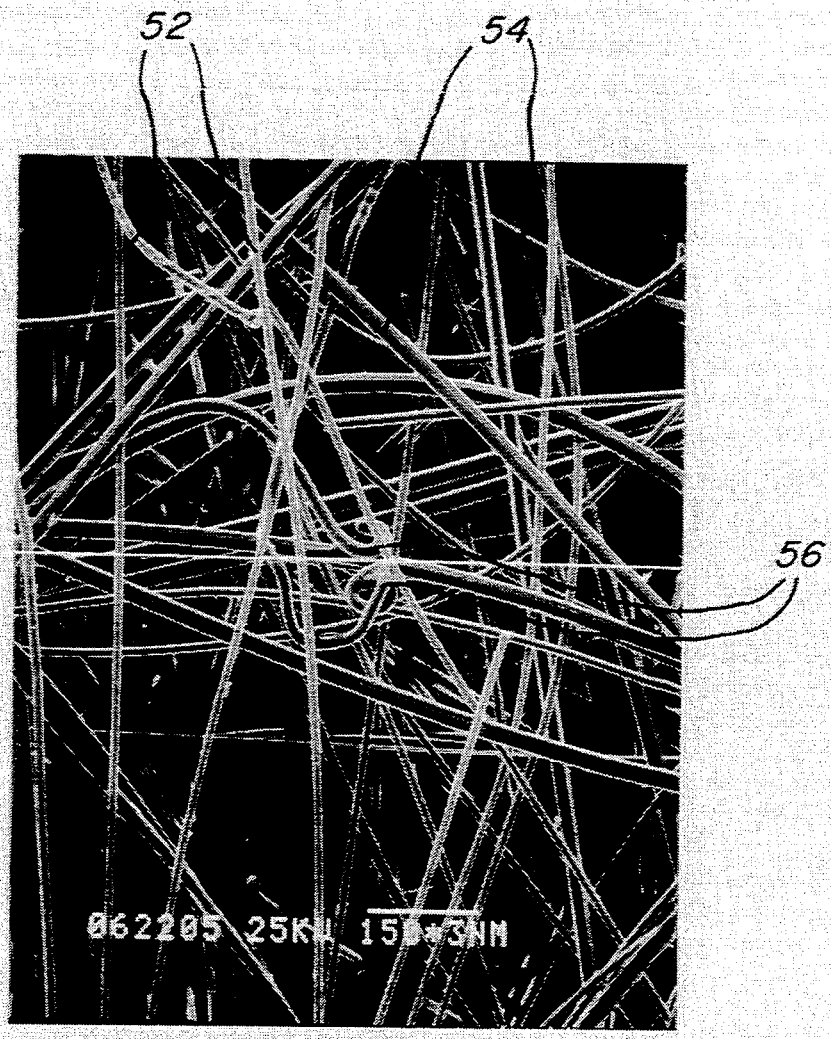
Figure 4C:
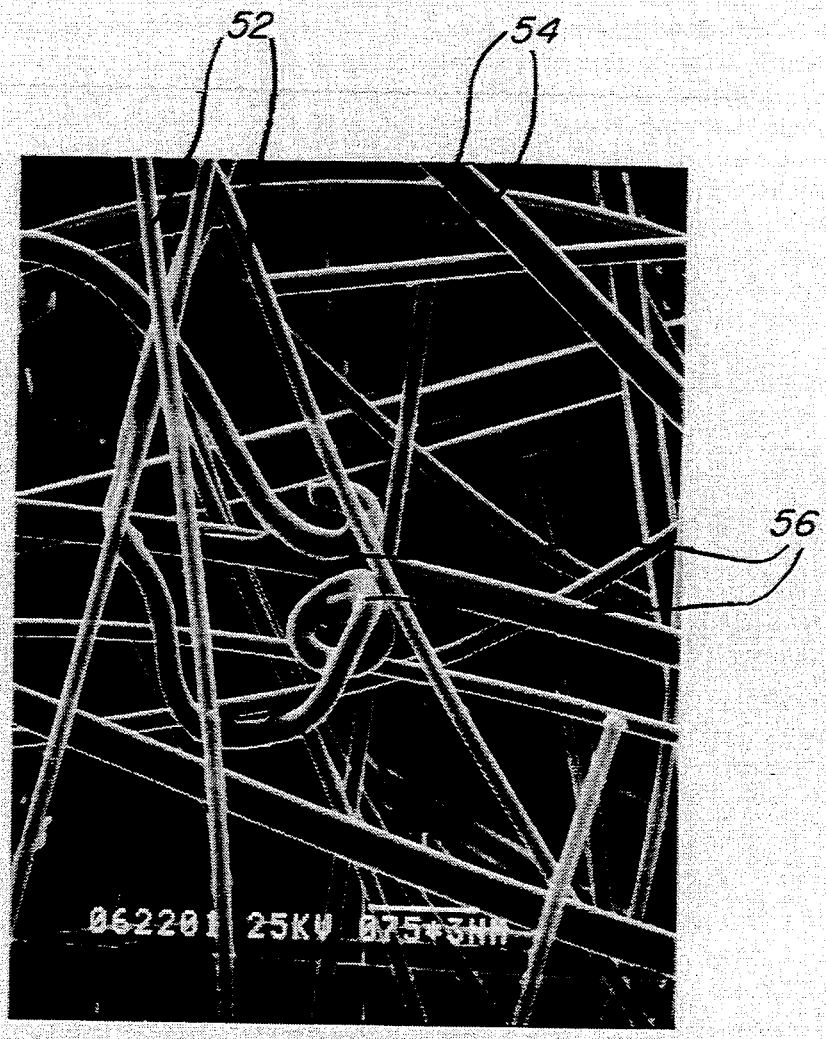

FIGS. 4A to 4C are photomicrographs of the uncalendared, i.e., unbonded, web material in accordance with the preferred embodiment, i.e., containing no polypropylene, respectively taken at magnifications of 50X, 100X and 200X. Fiber components in the composite material are identified in the photomicrographs as follows: 1.5-denier polyester fiber 52, 6.0-denier polyester fiber 54, and 2.0-denier bicomponent binder fiber 56. The uncalendared web has a microstructure of entangled individual fibers, that is, the bicomponent binder fibers do not exhibit bonding at fiber interfaces in the web matrix. As best seen in FIG. 4C, the web includes void areas in inter-fiber spaces.

Figure 5A:
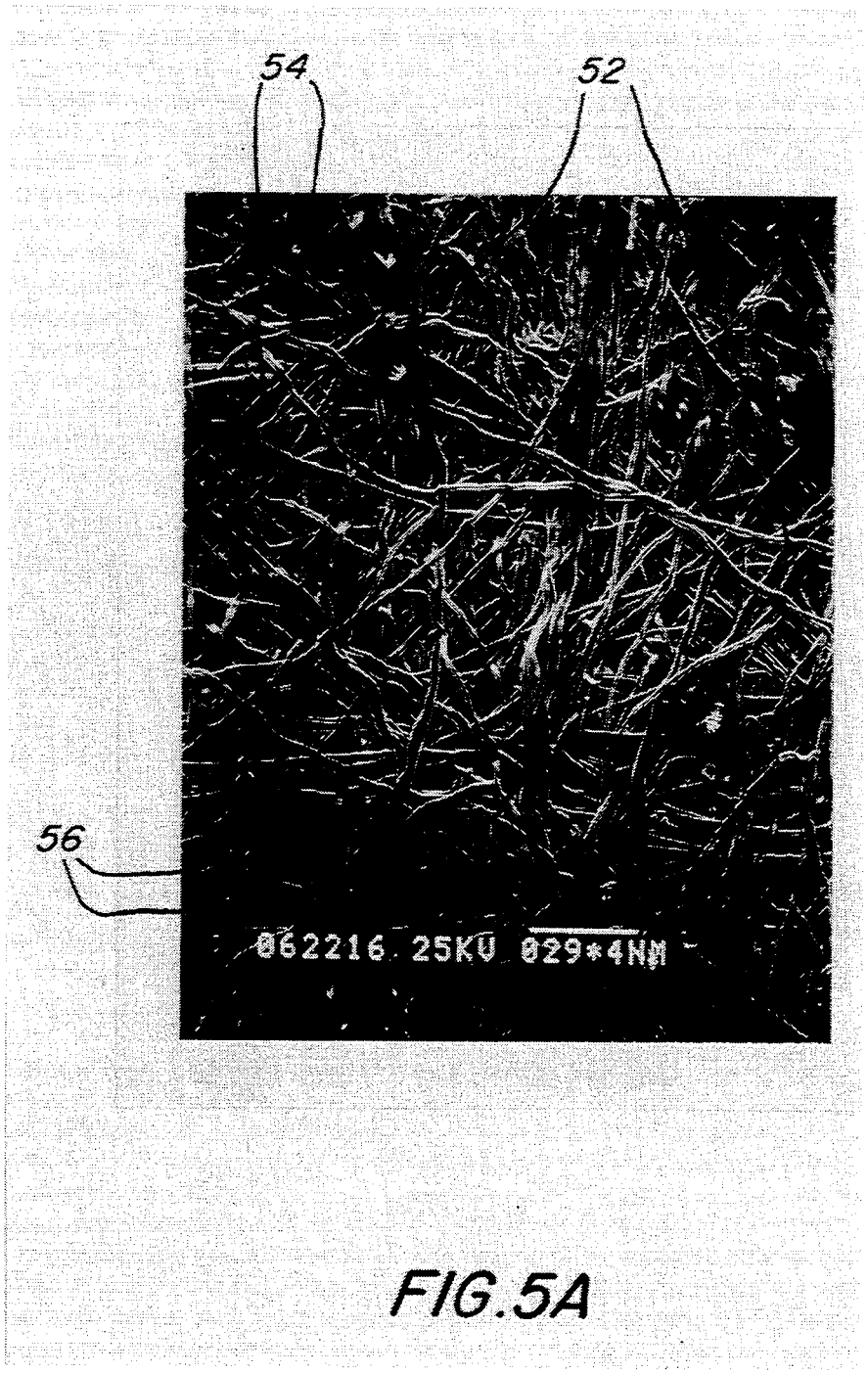
FIGS. 5A to 5C are photomicrographs, respectively at 50X, 100X and 200X magnification, showing the microstructure of a calendared web material in accordance with the preferred embodiment of the invention.
Figure 5B:
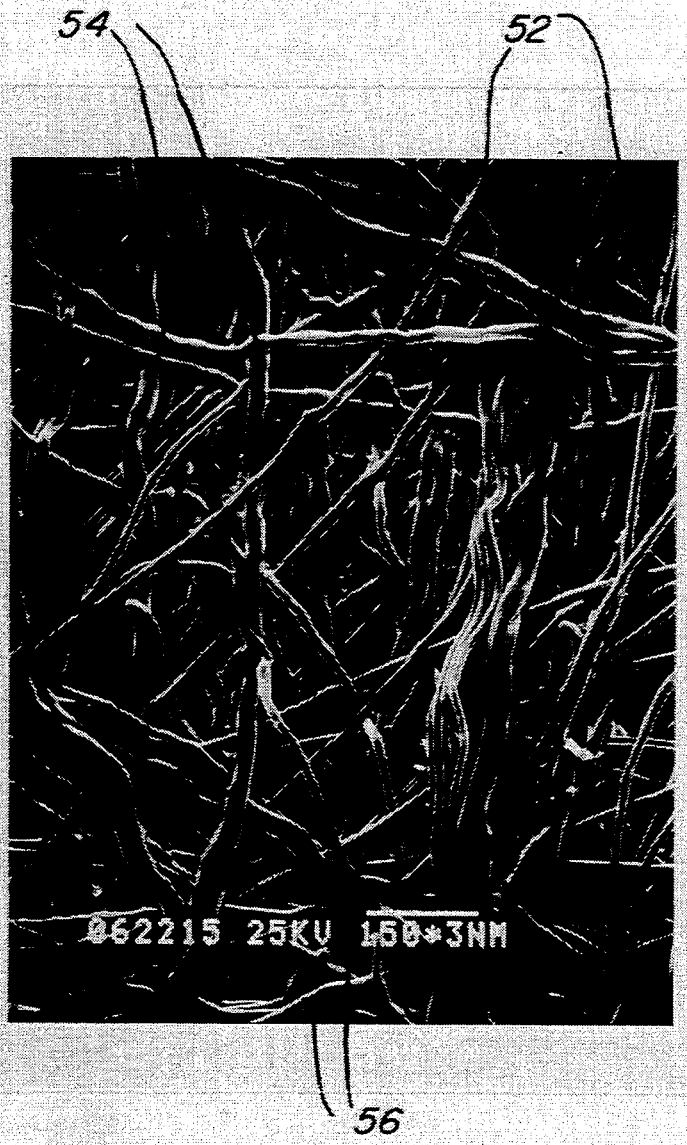
Figure 5C:
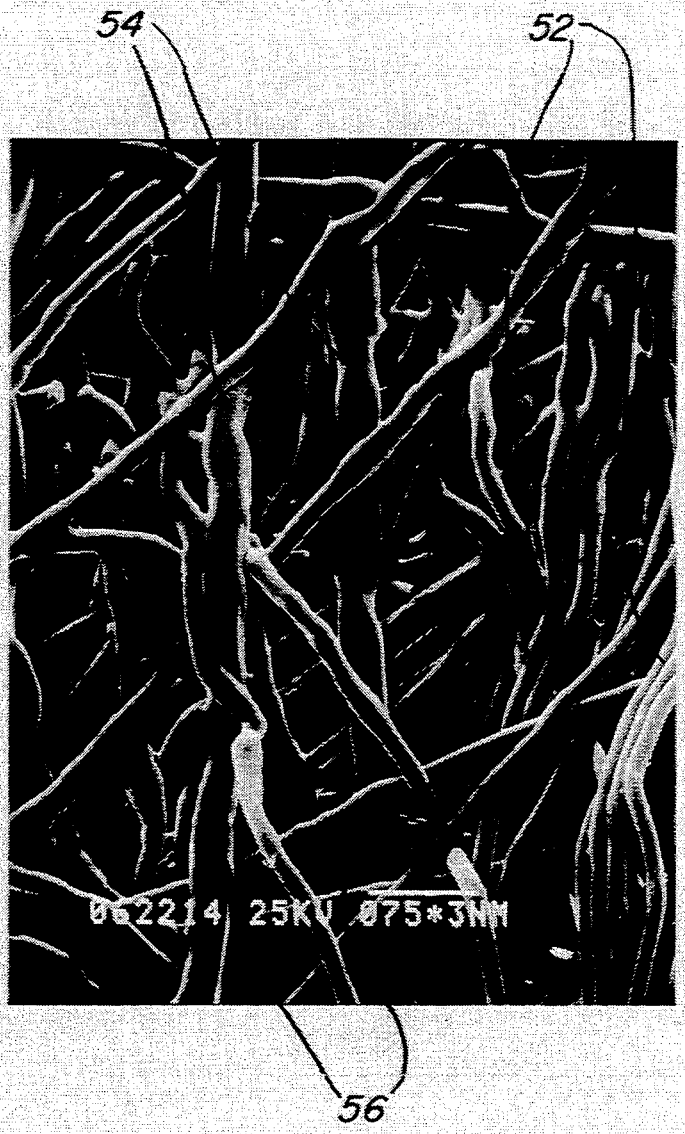

FIGS. 5A to 5C are photomicrographs of the thermally bonded web material in accordance with the preferred embodiment, i.e., containing no polypropylene, respectively taken at magnifications of 50X, 100X and 200X. Fiber components in the composite material shown in FIGS. 5A–5C are identified with the same reference numerals used in FIGS. 4A–4C.

The calendared composite exhibits a microstructure in which fiber interfaces are fused due to melting of the co-polyester sheath of the bicomponent binder fiber. The co-polyester sheath has a melting point lower than that of polyester. The calendaring of the composite web effects a reduction in the fiber spacing, i.e., by fiber compression and bonding. The density of the web material and the flatness (levelness) of the surface of the web material are substantially enhanced in the calendaring process.

The foregoing preferred embodiments have been described for the purpose of illustration only and are not intended to limit the scope of the claims hereinafter. Variations and modifications of the composition and method of manufacture may be devised which are nevertheless within the scope and spirit of the invention as defined in the claims appended hereto. For examples, it will be apparent to practitioners of ordinary skill that binder fibers different than those specified herein may be used, so long as the binder fiber contains thermoplastic material having a melting point lower than that of the polyester fibers and providing adequate bonding of those polyester fibers to form a nonwoven web with high tensile strength.

We claim:

1. A nonwoven composite web comprising:

15 to 50 wt. % of first polyester fibers having a first length and a first denier;

15 to 50 wt. % of second polyester fibers having a second length and a second denier; and 10 to 40 wt. % of binder fibers containing a thermoplastic binder material having a melting temperature less than the melting temperature of either of said first and second polyester fibers, wherein said first and second polyester fibers are bonded to form said nonwoven mat at least in part by solidification of said thermoplastic binder material after subjecting said fibers to temperatures in excess of said melting temperature of said thermoplastic binder material, but not in excess of the melting temperature of either of said first and second polyester fibers, wherein said first length is in the range of 5 mm to ¾ inch, said first denier is in the range of 0.3 to 3, said second length is in the range of 5 mm to 1-½ inches, and said second denier is in the range of 3 to 15.

2. The nonwoven composite web as defined in claim 1, comprising 40 wt. % of said first polyester fibers, 40 wt. % of said second polyester fibers, and 20 wt. % of said binder fibers.

3. The nonwoven composite web as defined in claim 1, further comprising up to 20 wt. % of polypropylene fibers.

4. The nonwoven composite web as defined in claim 1, wherein said binder fibers comprise bicomponent fibers having a core made of polyester and a sheath made of co-polyester, said co-polyester having a melting temperature which is less than the melting temperature of either of said first and second polyester fibers.

5. The nonwoven composite web as defined in claim 4, comprising 40 wt. % of said first polyester fibers, 40 wt. % of said second polyester fibers, and 20 wt. % of said bicomponent fibers.

6. The nonwoven composite web as defined in claim 1, wherein said binder fibers comprise third polyester fibers, said third polyester fibers having a melting temperature which is less than the melting temperature of either of said first and second polyester fibers.

7. The nonwoven composite web as defined in claim 1, comprising substantially no wood pulp.

8. A nonwoven composite web comprising:

15 to 50 wt. % of first polyester fibers having a length in the range of 5 mm to ¾ inch and a denier in the range of 0.3 to 3;

15 to 50 wt. % of second polyester fibers having a length in the range of 5 mm to 1-½ inches and a denier in the range of 3 to 15; and 10 to 40 wt. % of bicomponent binder fibers comprising a sheath of co-polyester and a core of polyester, said co-polyester having a melting temperature less than the melting temperature of either of said first and second polyester fibers, wherein said first and second polyester fibers are bonded to form said nonwoven mat at least in part by solidification of said co-polyester after subjecting said fibers to temperatures in excess of said melting temperature of said co-polyester, but not in excess of the melting temperature of either of said first and second polyester fibers.

9. The nonwoven composite web as defined in claim 8, comprising 40 wt. % of said first polyester fibers, 40 wt. % of said second polyester fibers, and 20 wt. % of said bicomponent binder fibers.

10. The nonwoven composite web as defined in claim 8, further comprising up to 20 wt. % of polypropylene fibers.

11. A method of manufacturing a nonwoven composite web comprising the following steps:

forming a furnish by mixing 15 to 50 wt. % of first polyester fibers having a first length and a first denier, 15 to 50 wt. % of second polyester fibers having a second length and a second denier, and 10 to 40 wt. % of binder fibers containing a thermoplastic binder material having a melting temperature less than the melting temperature of either of said first and second polyester fibers;

forming a web from said furnish by conventional papermaking techniques; and calendaring said web at a predetermined pressure and at a predetermined temperature in excess of said melting temperature of said thermoplastic binder material but less than said melting temperature of either of said first and second polyester fibers, wherein said predetermined temperature is in the range of 360° to 410° F. and said predetermined pressure is in the range of 40 to 70 psi and wherein said first length is in the range of 5 mm to ¾ inch, said first denier is in the range of 0.3 to 3, said second length is in the range of 5 mm to 1-½ inches, and said second denier is in the range of 3 to 15.

12. The method as defined in claim 11, wherein said predetermined temperature is in the range of 360° to 410° F. and said predetermined pressure is in the range of 40 to 70 psi.

13. The method as defined in claim 11, wherein the fiber composition of said furnish is 40 wt. % of said first polyester fibers, 40 wt. % of said second polyester fibers and 20 wt. % of said binder fibers.

14. The method as defined in claim 11, further comprising the step of adding up to 20 wt. % of polypropylene fibers to the fiber composition of said furnish.

15. The method as defined in claim 11, wherein said binder fibers comprise bicomponent fibers having a core made of polyester and a sheath made of co-polyester, said co-polyester having a melting temperature which is less than the melting temperature of either of said first and second polyester fibers.

16. The method as defined in claim 11, wherein said binder fibers comprise third polyester fibers, said third polyester fibers having a melting temperature which is less than the melting temperature of either of said first and second polyester fibers.

17. The method as defined in claim 11, wherein no wood pulp is added to said furnish.

* * * * *

UNITED STATES PATENT AND TRADEMARK OFFICE

CERTIFICATE OF CORRECTION

PATENT NO. : 5,403,444

DATED : April 4, 1995

INVENTOR(S) : James A. Goettmann et al.

It is certified that error appears in the above-identified patent and that said Letters Patent is hereby corrected as shown below:

Title page, item [57],

Abstract, line 3, change "5 to 50" to --15 to 50--.

Column 2, line 37, change "polyethylene" to -- co-polyester --.

Signed and Sealed this

Thirtieth Day of May, 1995

*Attest:*

Bruce Lehman

BRUCE LEHMAN

*Attesting Officer*

*Commissioner of Patents and Trademarks*